US006434764B2

(12) United States Patent
Primucci

(10) Patent No.: US 6,434,764 B2
(45) Date of Patent: Aug. 20, 2002

(54) WATER-PROOF JOINT FOR TUB SURROUND

(75) Inventor: Joseph Primucci, Toronto (CA)

(73) Assignee: Mirolin Industries Corporaiton (CA)

( * ) Notice: Subject to any disclaimer, the term of this patent is extended or adjusted under 35 U.S.C. 154(b) by 0 days.

(21) Appl. No.: 09/855,204

(22) Filed: May 14, 2001

Related U.S. Application Data

(60) Provisional application No. 60/204,623, filed on May 16, 2000.

(51) Int. Cl.[7] ..... A47K 3/02

(52) U.S. Cl. ..... 4/584; 4/614; 52/584.1; 52/588.1

(58) Field of Search ..... 4/584, 614; 52/791, 52/584.1, 588.1

(56) References Cited

U.S. PATENT DOCUMENTS 2,825,098 A * 3/1958 Hultquist ..... 52/584.1
3,028,603 A * 4/1962 Rodman ..... 4/584 X
3,827,086 A * 8/1974 Seymour et al. ..... 52/584 X
4,281,495 A * 8/1981 Lee ..... 52/584.1
5,473,843 A 12/1995 LaRoche et al.

FOREIGN PATENT DOCUMENTS

FR 620243 * 4/1927 ..... 4/584

* cited by examiner

*Primary Examiner*—Robert M. Fetsuga
(74) *Attorney, Agent, or Firm*—Carlson Gaskey & Olds

(57) ABSTRACT

A joint for a molded tub and surround which is formed of a multiple of portions. Mating wall surfaces are formed on both wall portions which extend generally parallel to the wall portions. An outer generally trapezoidal pair of surfaces are formed laterally spaced from the joint to engage a pair of parallel engagement surfaces substantially perpendicular to said first and second wall portions, and an angled engagement surface between said parallel engagement surfaces. One or more clips are received on the trapezoidal surfaces to further urge the surfaces into contact. The clip biases the two wall portions into contact such that there is a water tight seal at the joint.

20 Claims, 2 Drawing Sheets

WATER-PROOF JOINT FOR TUB SURROUND

The present application claims priority to U.S. Provisional Patent Application Ser. No. 60/204,623, filed May 16, 2000.

BACKGROUND OF THE INVENTION

The present invention relates to a waterproof joint between two wall portions for a molded plastic tub surround.

Tub surrounds are positioned within a recess built around a bathtub or shower. It is well known to provide a modular tub/shower unit which includes a tub portion at the bottom and two or more wall portions. The whole structure is inserted into the wall recess to form a completely waterproof surround. The fully enclosed waterproof structure is highly advantageous in that it prevents the escape of water into the wall cavity despite the shower spraying water onto the surrounding walls.

One problem which has always arisen with products of this type is that of forming a suitable joint between the tub surround portions. Various styles of joint have been used including butt joints and lap joints each providing particular tradeoffs in complexity, aesthetics and sealing ability.

Accordingly, it is desirable to provide a waterproof joint between two wall portions for a molded plastic tub surround which is uncomplicated an aesthetically pleasing while assuring an effective watertight seal.

SUMMARY OF THE INVENTION

The present invention provides a joint for a molded tub and surround which is formed of a multiple of portions. An outer trapezoidal pair of surfaces are formed laterally spaced from the joint to engage a pair of parallel engagement surfaces substantially perpendicular to said first and second wall portions, and an angled engagement surface between said parallel engagement surfaces. One or more clips are received on the trapezoidal surfaces to further urge the surfaces into contact. The clip biases the two wall portions into contact such that there is a watertight seal at the joint.

The present invention therefore provides a waterproof joint between two wall portions of a molded plastic tub surround which is uncomplicated and aesthetically pleasing.

BRIEF DESCRIPTION OF THE DRAWINGS

The various features and advantages of this invention will become apparent to those skilled in the art from the following detailed description of the currently preferred embodiment. The drawings that accompany the detailed description can be briefly described as follows.

DETAILED DESCRIPTION OF THE PREFERRED EMBODIMENT

Figure 1:
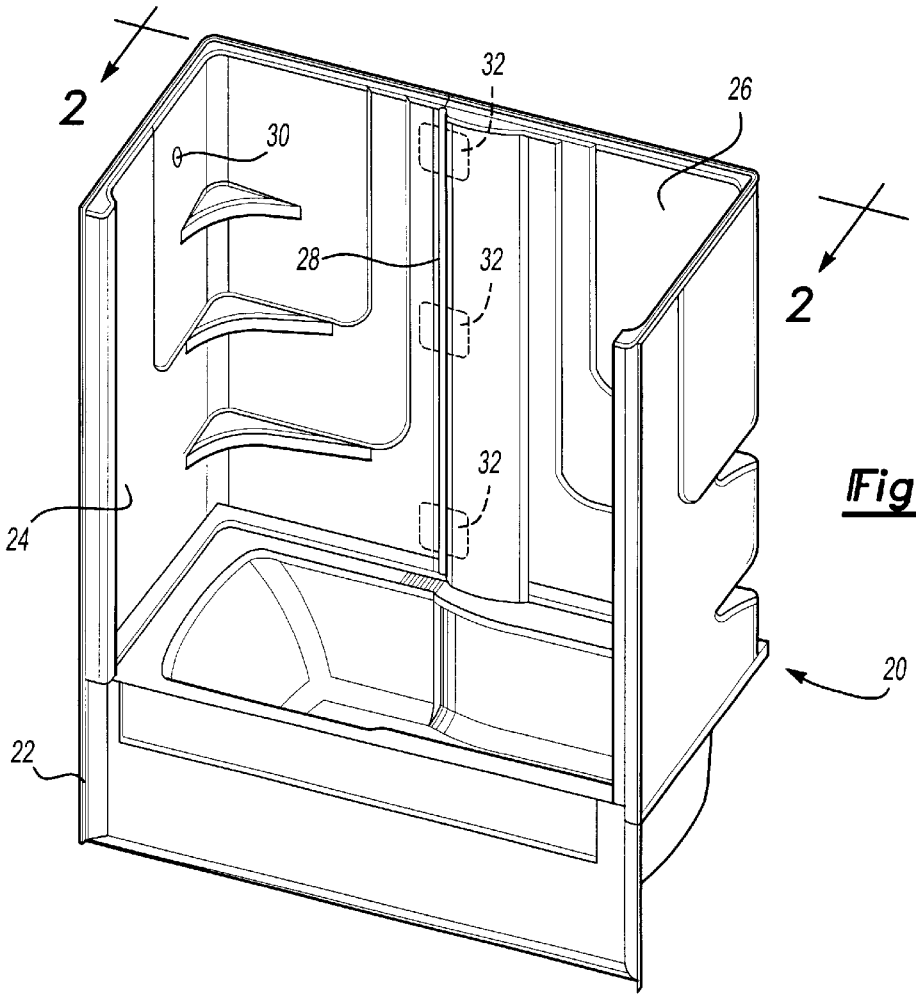
FIG. 1 is a general perspective view a molded tub and surround according to the present invention.

FIG. 1 illustrates a general perspective view of a molded tub and surround 20 which is formed of three pieces of molded plastic. In particular, a tub portion 22 receives wall portions 24 and 26 to form the combined tub and surround 20. A joint 28 is defined between the wall portions 24 and 26.

A shower head 30 is preferably mounted within the wall 24 such that water will move in the direction of left to right in FIG. 1. A plurality of clamps 32 are spaced vertically along the joint 28.

Figure 2:
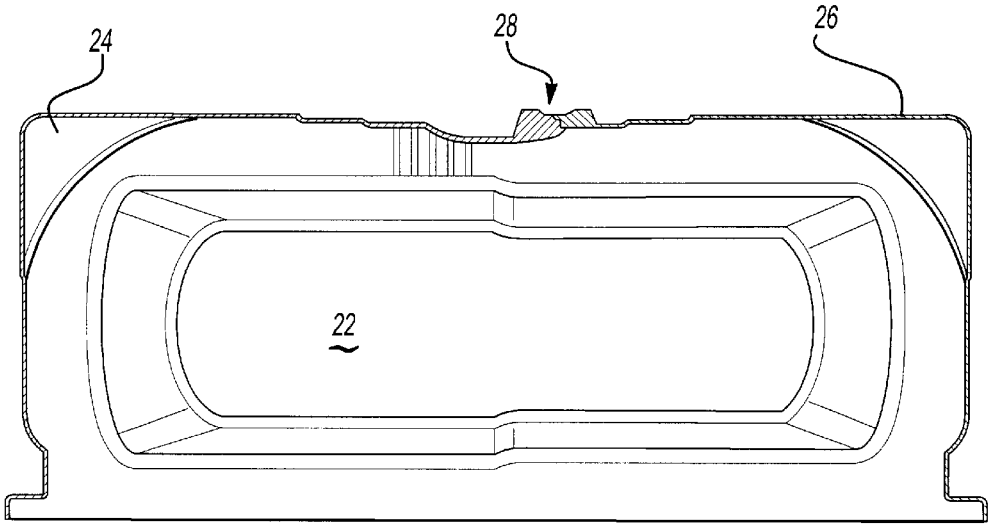
FIG. 2 is a sectional view taken along line 2—2 of FIG. 1.

Referring to FIG. 2, the wall portions 24 and 26 meet at the joint 28. The wall portions 24 and 26 sit on the tub portion 22. It should be understood that any number of wall portions will benefit from the present invention.

Figure 3:
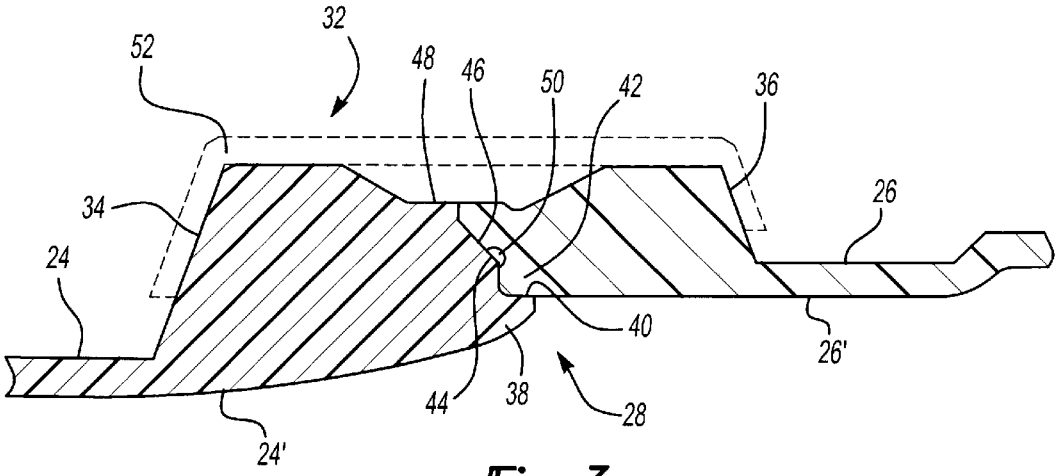
FIG. 3 is an exploded sectional view of the water tight seal at the joint.

Referring to FIG. 3, details of the joint 28 are illustrated. Outer generally trapezoidal pair of surfaces 34 and 36 are formed laterally spaced from the joint 28. That is, the surfaces 34, and 36 extend in a generally non-parallel manner from the wall portions 24 and 26. Surface 40 is preferably opposite of a visible side 24' of wall portions 24 and engages a visible side 26' of wall 26. Trapezoidal surfaces 34 and 36 are preferably opposite visible sides 24', 26'. The term "visible" relates to the side of the wall portions 24,26 which face toward the interior of the tub portion 22 and does not mean that the engagements portions will actually be "visible" after assembly.

A parallel engagement surface such as an overlap lip 38 formed on the wall portion 24 rests on a surface 40 of the wall part 26. The overlap lip 38 is on the visible side 24' of wall portion 24 and extends over the visible side 26' of wall portion 26. Preferably, the overlap lip 38 is appropriately shaped to blend in with the overall surround 10 design. An end surface 42 of the wall part 26 abuts a wall 44 of the wall 28. Mating angled surfaces 46 are formed on both of walls 24 and 26 extending laterally inwardly from the surfaces 44.

Mating wall surfaces 48 are formed on both walls 24 and 26 and extend generally parallel to the wall portions 44. A space 50 is formed into the wall 26 in the wall portion 46. Space 50 is preferably substantially radial in shape to receive a further sealing material such as silicon caulking or the like.

In a mounted position, the dimension of the walls 24 and 26 is selected such that when mounted in a bathroom, the wall surfaces 24 and 26 are biased toward each other at the joint portion. Moreover, a clip 52 is received on the surfaces 34 and 36 to further urge the surfaces into contact. That is, the surfaces 34, and 36 are accessible after assembly of the wall portions 24 and 26 to receive clip 52.

As can be appreciated from FIG. 3, the clip biases the two end portions of the walls 24 and 26 into contact such that there is a water tight seal at the joint. The dimensions of the walls 24 and 26 are such that they are biased along their entire length into contact.

The foregoing description is exemplary rather than defined by the limitations within. Many modifications and variations of the present invention are possible in light of the above teachings. The preferred embodiments of this invention have been disclosed, however, one of ordinary skill in the art would recognize that certain modifications would come within the scope of this invention. It is, therefore, to be understood that within the scope of the appended claims, the invention may be practiced otherwise than as specifically described. For that reason the following claims should be studied to determine the true scope and content of this invention.

What is claimed is:

1. A tub surround comprising:

a first wall portion having a first visible side and a first surface which extends in a non-parallel relationship opposite said first visible surface and a second wall portion having a second visible side and a second surface which extends in a non-parallel relationship opposite said second visible surface;

a joint between said first and second wall portion said first surface and said second surface laterally spaced on opposite sides of said joint; and said joint including a pair of parallel engagement surfaces with an angled engagement surface between said parallel engagement surfaces.

2. The tub surround as recited in claim 1, further including a clip engageable with said first and second wall portion.

3. The tub surround as recited in claim 2, further including a first trapezoidal surface extending from said first wall portion and a second trapezoidal surface extending from said second wall portion, said clip engageable with said first and second trapezoidal surfaces.

4. The tub surround as recited in claim 3, wherein said clip is substantially U-shaped.

5. The tub surround as recited in claim 1, further including a parallel engagement surface substantially parallel to said first and second wall portions.

6. The tub surround as recited in claim 5, wherein said first wall portions overlaps said second wall portion at said parallel engagement surface.

7. The tub surround as recited in claim 1, wherein said angled engagement surface defines a space.

8. A tub surround comprising:

a first wall portion having a visible side and a first trapezoidal surface opposite said visible surface;

a second wall portion having a visible side and a second trapezoidal surface;

a joint between said first and second trapezoidal surfaces;

said joint including a pair of parallel engagement surfaces substantially perpendicular to said first and second wall portions, and an angled engagement surface between said parallel engagement surfaces.

9. The tub surround as recited in claim 8, further including a parallel engagement surface substantially parallel to said first and second wall portions.

10. The tub surround as recited in claim 9, wherein said first wall portions overlaps said second wall portion at said parallel engagement surface.

11. The tub surround as recited in claim 1, wherein said angled engagement surface defines a space.

12. A tub surround comprising:

a first wall portion having a visible side and a first trapezoidal surface opposite said visible surface;

a second wall portion having a visible side and a second trapezoidal surface;

a joint between said first and second trapezoidal surfaces;

said joint including a pair of parallel engagement surfaces substantially perpendicular to said first and second wall portions, an angled engagement surface between said parallel engagement surfaces, and an overlap lip engagement surface substantially parallel to said first and second wall portions.

a clip engagable with said first and second trapezoidal surface to bias said first wall portion toward said second wall portion.

13. A tub surround comprising:

a first and second wall portion and a joint between said first and second wall portion;

said joint including a pair of parallel engagement surfaces with an angled engagement surface between said parallel engagement surfaces; and a clip engageable with said first and second wall portion.

14. The tub surround as recited in claim 13, wherein said clip biases said first wall portion toward said second wall portion.

15. The tub surround as recited in claim 1, wherein said first surface and said second surface are accessible.

16. The tub surround as recited in claim 15, wherein said first surface and said second surface are generally perpendicular to said first wall portion and said second wall portion.

17. The tub surround as recited in claim 15, wherein said first surface and said second surface are angled toward each other.

18. The tub surround as recited in claim 1, wherein said first wall portion and said second wall portion are non-planar.

19. The tub surround as recited in claim 1, wherein said first wall portion and said second wall portion are solid.

20. The tub surround as recited in claim 8, wherein said first and second trapezoidal surfaces are accessible.

* * * * *